US009360815B2

(12) United States Patent
Sato

(10) Patent No.: US 9,360,815 B2
(45) Date of Patent: Jun. 7, 2016

(54) IMAGE FORMING APPARATUS, WORK SUPPORT METHOD OF IMAGE FORMING APPARATUS, STORAGE MEDIUM AND PROGRAM

(71) Applicant: CANON KABUSHIKI KAISHA, Tokyo (JP)

(72) Inventor: Masayuki Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/510,649

(22) Filed: Oct. 9, 2014

(65) Prior Publication Data

US 2015/0104211 A1 Apr. 16, 2015

(30) Foreign Application Priority Data

Oct. 11, 2013 (JP) ..... 2013-213618

(51) Int. Cl.
*G03G 15/00* (2006.01)

(52) U.S. Cl.
CPC ..... *G03G 15/502* (2013.01)

(58) Field of Classification Search
CPC . G03G 15/50; G03G 15/502; H04N 1/00408; H04N 2201/0082
See application file for complete search history.

(56) References Cited

U.S. PATENT DOCUMENTS 8,010,009 B2 * 8/2011 Mochizuki ..... H04N 1/00408 399/81
2012/0063801 A1 * 3/2012 Higashi ..... G03G 15/5016 399/81
2013/0135646 A1 * 5/2013 Akiyama et al. ..... 358/1.13

FOREIGN PATENT DOCUMENTS

JP 2000-85220 A 3/2000

* cited by examiner

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

An image forming apparatus capable of switching play pattern of a moving image for guidance of work, the pattern including a pattern for a toner bottle replacement work and pattern for a jam release work, is provided. When a toner bottle replacement work is detected, the work contents displayed on the operation unit are guided by the moving image which is continuously played. On the other hand, when a jam release work is to be performed, the work contents are guided by the moving image which is paused for each work unit to wait for a play instruction.

12 Claims, 7 Drawing Sheets

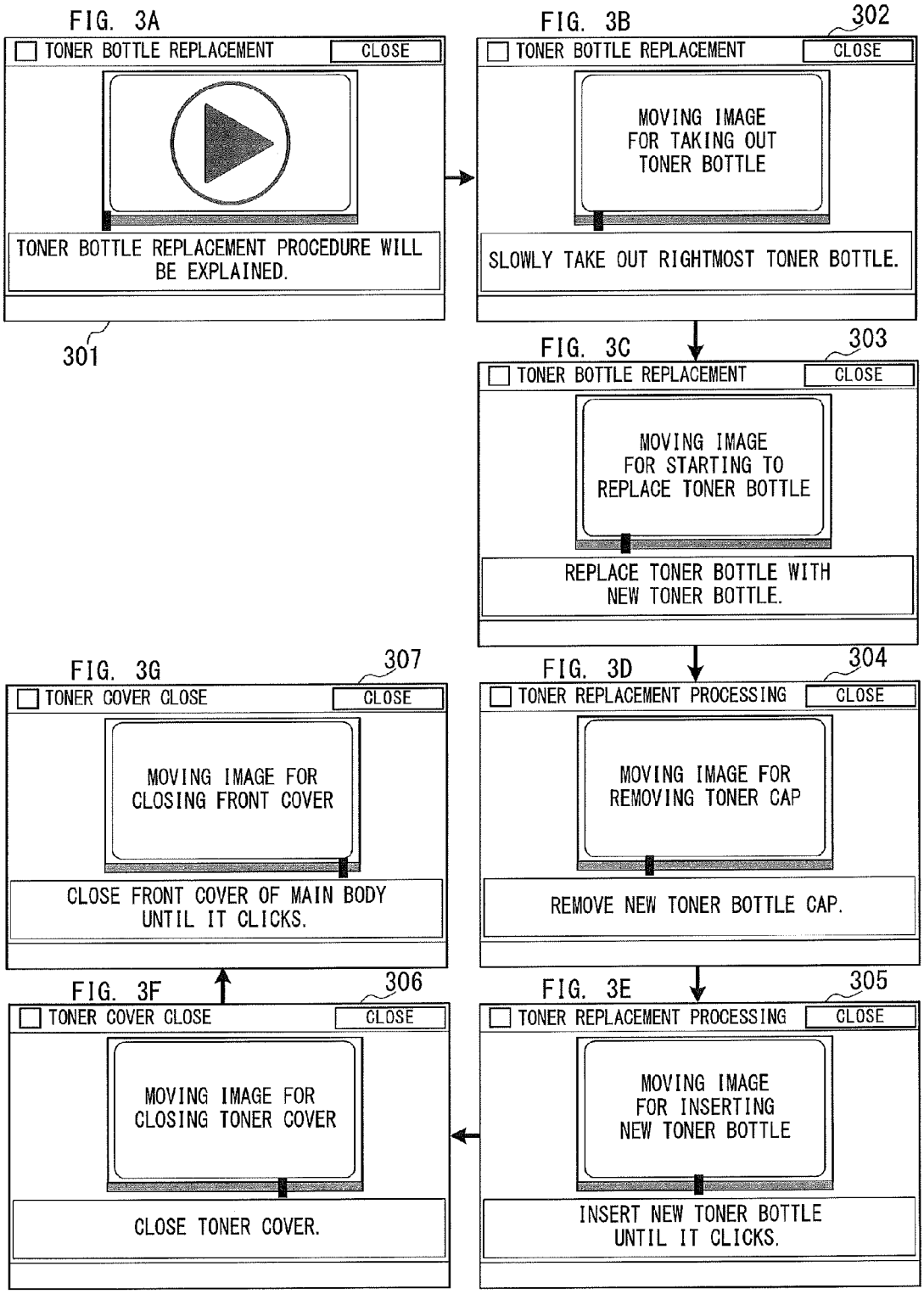
FIG. 3A
TONER BOTTLE REPLACEMENT
CLOSE
TONER BOTTLE REPLACEMENT PROCEDURE WILL BE EXPLAINED.
301
FIG. 3B
302
TONER BOTTLE REPLACEMENT
CLOSE
MOVING IMAGE FOR TAKING OUT TONER BOTTLE
SLOWLY TAKE OUT RIGHTMOST TONER BOTTLE.
FIG. 3C
303
TONER BOTTLE REPLACEMENT
CLOSE
MOVING IMAGE FOR STARTING TO REPLACE TONER BOTTLE
REPLACE TONER BOTTLE WITH NEW TONER BOTTLE.
FIG. 3D
304
TONER REPLACEMENT PROCESSING
CLOSE
MOVING IMAGE FOR REMOVING TONER CAP
REMOVE NEW TONER BOTTLE CAP.
FIG. 3E
305
TONER REPLACEMENT PROCESSING
CLOSE
MOVING IMAGE FOR INSERTING NEW TONER BOTTLE
INSERT NEW TONER BOTTLE UNTIL IT CLICKS.
FIG. 3F
306
TONER COVER CLOSE
CLOSE
MOVING IMAGE FOR CLOSING TONER COVER
CLOSE TONER COVER.
FIG. 3G
307
TONER COVER CLOSE
CLOSE
MOVING IMAGE FOR CLOSING FRONT COVER
CLOSE FRONT COVER OF MAIN BODY UNTIL IT CLICKS.

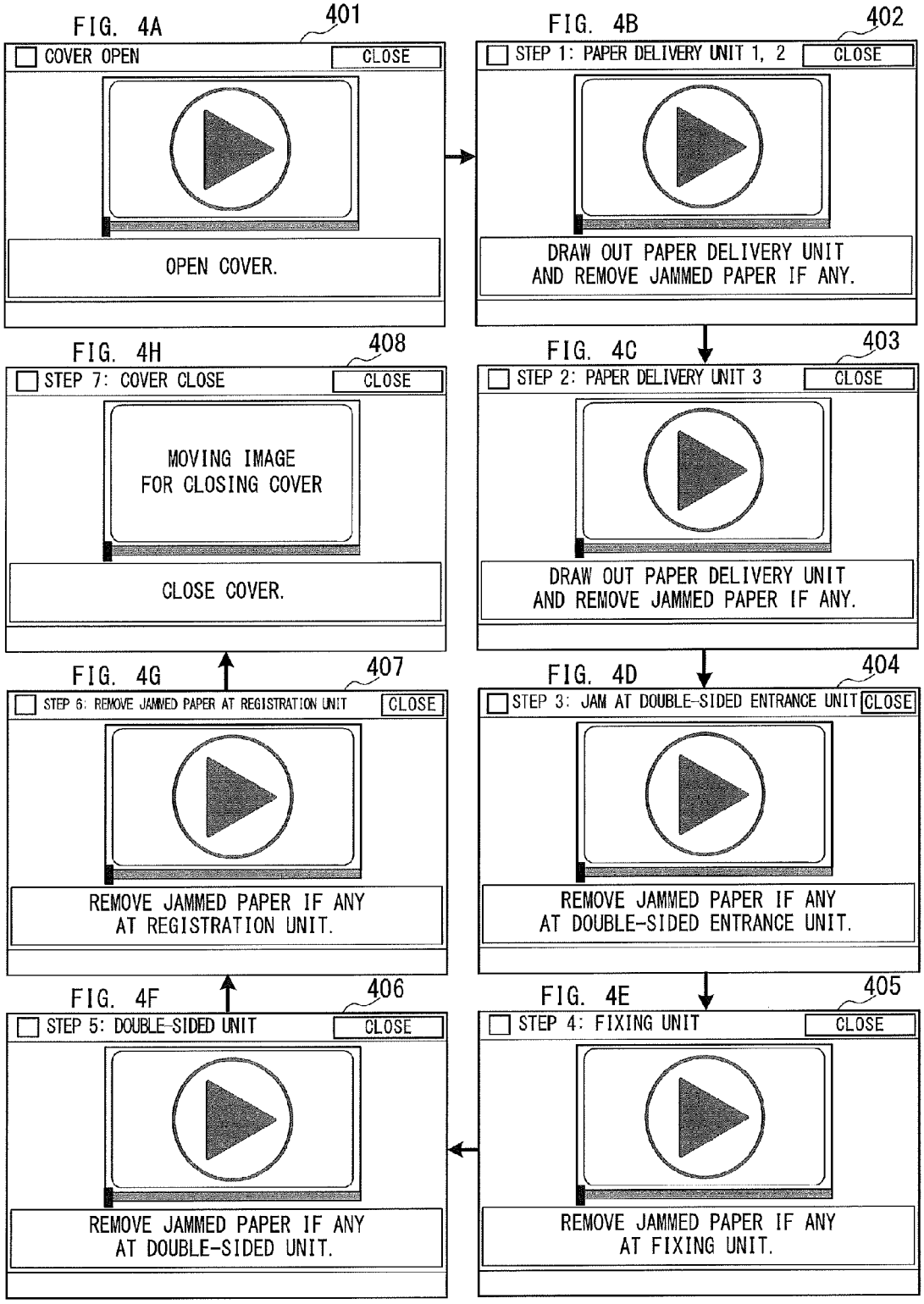
FIG. 4A
401
COVER OPEN
CLOSE
OPEN COVER.
FIG. 4B
402
STEP 1: PAPER DELIVERY UNIT 1, 2
CLOSE
DRAW OUT PAPER DELIVERY UNIT
AND REMOVE JAMMED PAPER IF ANY.
FIG. 4C
403
STEP 2: PAPER DELIVERY UNIT 3
CLOSE
DRAW OUT PAPER DELIVERY UNIT
AND REMOVE JAMMED PAPER IF ANY.
FIG. 4D
404
STEP 3: JAM AT DOUBLE-SIDED ENTRANCE UNIT
CLOSE
REMOVE JAMMED PAPER IF ANY
AT DOUBLE-SIDED ENTRANCE UNIT.
FIG. 4E
405
STEP 4: FIXING UNIT
CLOSE
REMOVE JAMMED PAPER IF ANY
AT FIXING UNIT.
FIG. 4F
406
STEP 5: DOUBLE-SIDED UNIT
CLOSE
REMOVE JAMMED PAPER IF ANY
AT DOUBLE-SIDED UNIT.
FIG. 4G
407
STEP 6: REMOVE JAMMED PAPER AT REGISTRATION UNIT
CLOSE
REMOVE JAMMED PAPER IF ANY
AT REGISTRATION UNIT.
FIG. 4H
408
STEP 7: COVER CLOSE
CLOSE
MOVING IMAGE
FOR CLOSING COVER
CLOSE COVER.

IMAGE FORMING APPARATUS, WORK SUPPORT METHOD OF IMAGE FORMING APPARATUS, STORAGE MEDIUM AND PROGRAM

BACKGROUND OF THE INVENTION

1. Field of the Invention

The present invention relates to an image forming apparatus comprising a function for performing, when a trouble (such as a jam) relating to an image formation occurs, guidance for appropriately supporting to solve such trouble.

2. Description of the Related Art

Conventionally, there is known an image forming apparatus disclosed in Japanese Patent Application Laid-open No. 2000-085220, in which, when a trouble relating to an image formation occurs, or when a state change of a device of the image forming apparatus occurs, a technology for performing guidance for a work procedure to respond to such circumstances is disclosed. In this image forming apparatus, when a jam occurs in a sheet conveyance path, a jam occurrence position and a jam treatment contents are displayed. Also, the image forming apparatus performs guidance for a work procedure to release the jam. In particular, in this image forming apparatus, a user is prompted to depress a forward key on an operation panel, thereby the moving image is sequentially switched and cyclically played and displayed.

However, in the image forming apparatus as disclosed in Japanese Patent Application Laid-open No. 2000-085220, regardless of a type of a jam, when performing guidance, the operation of depressing the forward key on the operation panel is always required to advance the moving image next. This therefore leaves a problem that guidance in accordance with work as needed cannot be provided. For example, suppose that work requiring replacing a toner bottle occurs. In this case, a user replaces the toner bottle while watching a moving image showing how to replace the toner bottle. It means that the moving image is required to be continuously played. On the other hand, suppose that a jam occurs in a sheet conveyance path. To release the jam, works at plurality of regions are required. If it takes time to release the jam at certain region, even the moving image is displayed, the user may miss some important point in the moving image.

It will be convenient for a user if a way of providing the moving image can be changed in accordance with the work contents, which will be expected to match intention for support side.

The main object of the present invention is to provide an image forming apparatus which can improve usability when performing guidance for work procedure.

SUMMARY OF THE INVENTION

According to an aspect of the present disclosure, an image forming apparatus comprises a detection unit configured to detect an event which relates to an image formation; a storing unit configured to store work contents to respond to the event for each event; a display device for displaying the work contents; and a control unit configured to display the work contents read from the storing unit on the display device, in accordance with the type of the event detected by the detection unit, in a moving image pattern selected from a first moving image pattern and a second moving image pattern. The moving image is paused for each work unit to wait for a play instruction in the first moving image pattern, and the moving image is continuously played in the second moving image pattern.

Further features of the present invention will become apparent from the following description of exemplary embodiments (with reference to the attached drawings).

BRIEF DESCRIPTION OF THE DRAWINGS

FIGS. 3A to 3G are schematic diagrams illustrating screen transition examples displayed on an operation unit.

FIGS. 4A to 4H are schematic diagrams illustrating screen transition examples displayed on an operation unit.

DESCRIPTION OF THE EMBODIMENTS

Now, an embodiment of the present invention will be described with reference to the drawings.

[Configuration of Image Forming Apparatus]

According to an embodiment of the present invention, play patterns of moving image are provided. In some patterns, when moving image, showing work contents for solving a trouble, is played, the moving image is paused for each work unit. Also, in the other patterns, the moving image is continuously displayed when the moving image is played. This allows a user to select play pattern of the moving image in accordance with the work contents, which can improve usability when guidance for a work procedure is performed.

Figure 1:
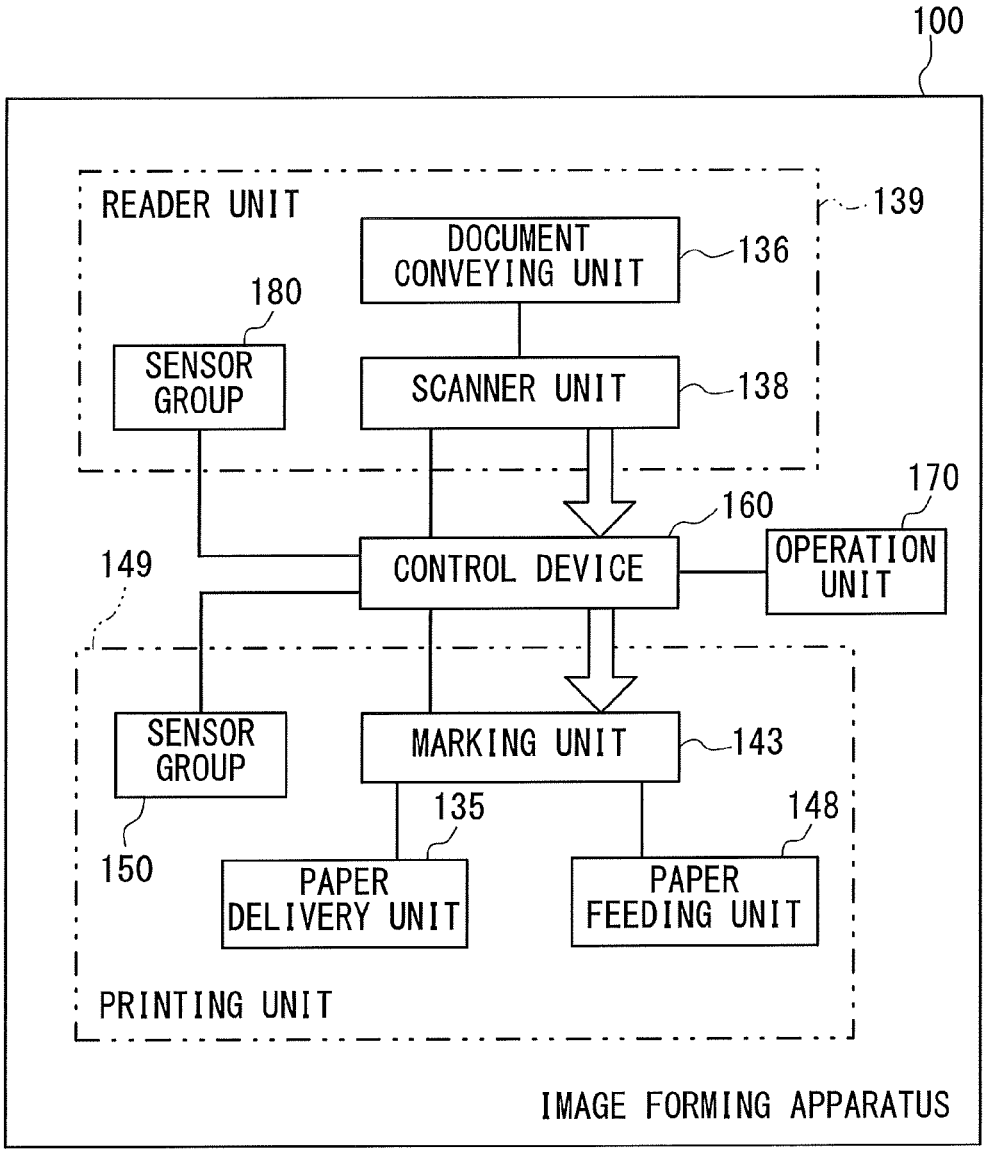
FIG. 1 is a block diagram illustrating a configuration example of an image forming apparatus according to an embodiment.

FIG. 1 is a block diagram illustrating a configuration example of an image forming apparatus according to an embodiment of the present invention. The image forming apparatus 100 comprises a reader unit 139, a printing unit 149, a control device 160, and an operation unit 170.

The reader unit 139 comprises a document conveying unit 136, a scanner unit 138, and a sensor group 180. The document conveying unit 136 is used to convey document to be read. The scanner unit 138 is used to read the document conveyed from the document conveying unit 136. The image data read by the scanner unit 138 is input to the control device 160.

The sensor group 180 comprises a plurality of sensors, which are provided at each important point of the conveyance path of the document of the reader unit 139. The sensor group 180 detects state change in the conveyance path. For example, the sensor group 180 detects whether or not there is a document in the conveyance path. It also detects an occurrence of jam and an occurrence position of the jam. The detection result is used when a timing to convey the document is controlled by the control device 160. Also, the detection result is used to notify the control device 160 of the occurrence of the jam and the occurrence position of the jam.

The printing unit 149 comprises a paper feeding unit 148, a marking unit 143, a paper delivery unit 135, and a sensor group 150. The paper feeding unit 148 mounts a plurality of cassettes for respectively storing recording paper of different size, from which, the recording paper is fed. In the marking unit 143, an image forming processing by electrophotographic is performed. In the marking unit 143, an image formation is performed on the recording paper fed from the paper delivery unit 148 based on the image data input from the scanner unit 138 via the control device 160. The paper delivery unit 135 sorts or staples the recording paper, on which the images are formed by the marking unit 143, and then, delivers the recording paper to the outside of the device.

The sensor group 150 comprises a plurality of sensors, which are provided at each important point of the conveyance path of the recording paper of the printing unit 149. The sensor group 150 detects state change in the conveyance path. For example, the sensor group 150 detects whether or not there is a recording paper in the conveyance path before printing or after printing. It also detects an occurrence of jam, and an occurrence position of the jam. The detection result is used when a timing to convey the recording paper is controlled by the control device 160. Also, the detection result is used to notify the control device 160 of the occurrence of the jam and the occurrence position of the jam.

The control device 160 controls operation of the reader unit 139, the printing unit 149, and the operation unit 170. In particular, the control device 160 reads the image data of the document by the reader unit 139. The image data is then output to the printing unit 149 to thereby form images on the recording paper. This realizes copy function. Based on guidance information previously held and detection results occasionally input by the sensor groups 150 and 180, the control device 160 realizes guidance function. Through the guidance function, a work procedure including work contents for the user is represented to a user.

The operation unit 170 is one example of a display device, and comprised of, for example, an operation panel with a touch screen. Various keys are displayed on a display screen of the touch screen. The various keys are used to receive instruction input by the user to the control device 160. A maintenance screen, showing a work procedure for the user to perform the work, is also displayed on the display screen. Information input through the various keys displayed on the display screen is output to the control device 160. The maintenance screen is displayed based on guidance information output from the control device 160.

Next, a particular configuration example of the control device 160 will be described.

Figure 2:
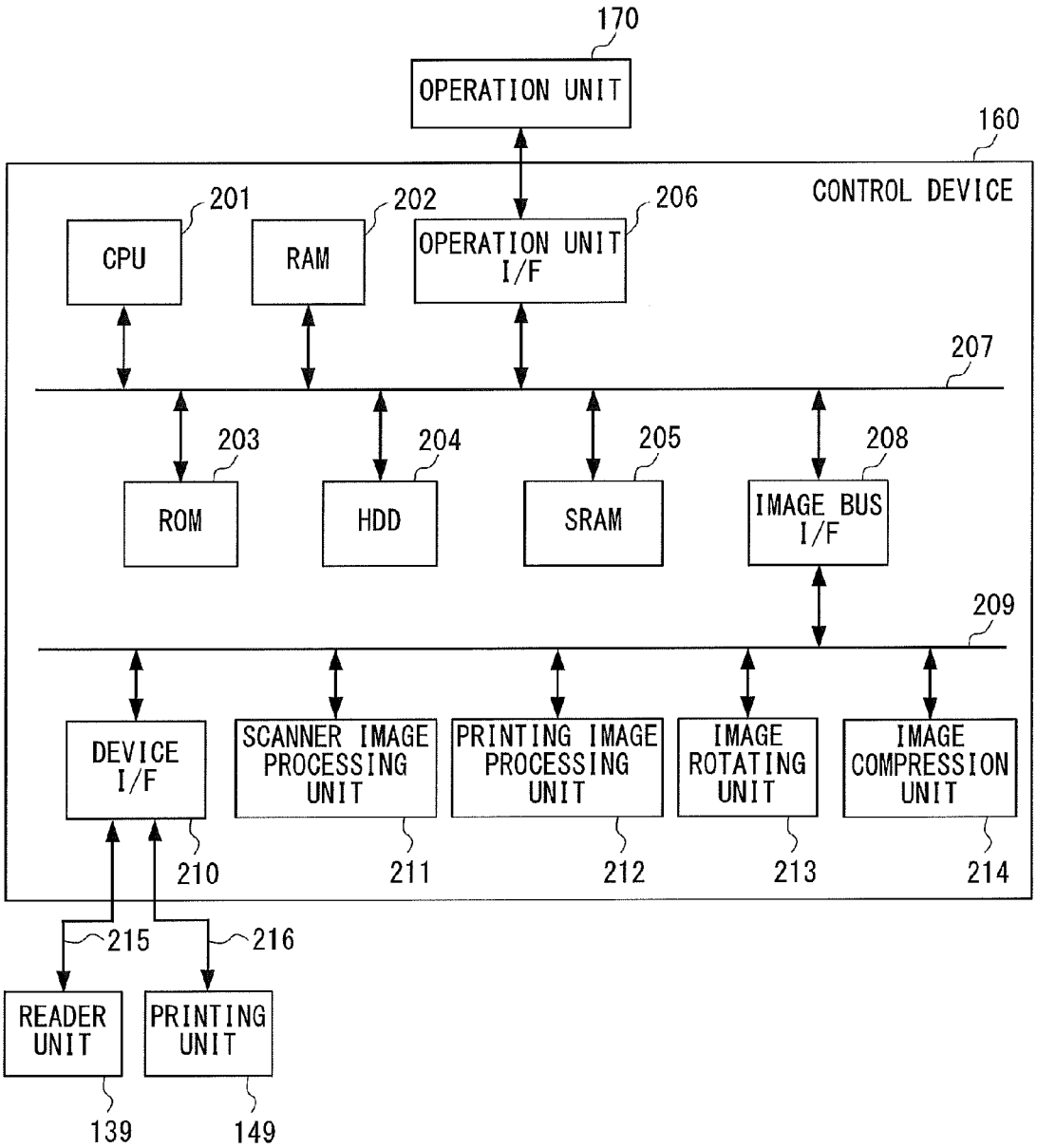
FIG. 2 is a block diagram illustrating a configuration example of a control device.

FIG. 2 is a block diagram illustrating a configuration example of the control device 160 according to the present embodiment. The control device 160 comprises a CPU (Central Processing Unit) 201 for totally controlling operation of the image forming apparatus. A RAM (Random Access Memory) 202 is a work memory for the CPU 201. The Ram 202 also serves as an image memory for temporarily storing image data.

A ROM (Read Only Memory) 203 is a read-only memory including a boot ROM, a ROM for program and a data ROM. The boot ROM stores boot program. The ROM for program stores control program which will be needed for realizing predetermined function by the CPU 201. The data ROM is a non-volatile memory capable of electrically writing and erasing storage contents. For example, an EEPROM (Electrically Erasable Programmable Read-Only Memory) can be used as the data ROM. The data ROM stores data such as parameter, which will be needed for realizing predetermined function by the CPU 201.

Various software including program for guidance, image data, and guidance information are stored on a hard disc drive (HDD) 204 in freely updated manner.

Through the guidance information, when an event which relates to an image formation occurs, work contents or procedures to respond to the event are shown. Alternatively, through the guidance information, work which will be needed to resume a job suspended due to the occurrence of the trouble is shown. For example, through the guidance information, when a trouble such as a jam occurs, work contents or procedures for releasing the jam are shown. Alternatively, through the guidance information, work which will be needed to resume a job suspended due to the occurrence of the trouble is shown. Also, through the guidance information, when state change occurs in a plurality of devices, work contents or procedures to respond to the state change are shown. Alternatively, through the guidance information, work which will be needed to resume a job is shown. The "device" used herein refers a toner bottle or mounting interface for a toner bottle or cassette for recording paper etc. The guidance information is visualized through messages, still images, moving images or combination thereof.

The guidance information is prepared for each event. For example, the guidance information is prepared for each position at which the trouble occurs, for each type of trouble, or for each device. The moving image is divided into each work code representing the type of the work. Alternatively, the moving image is divided into each detailed work code, by which the moving image is subdivided into each work unit. By setting the detailed work code, it becomes possible to display the moving image in such a manner that the moving image is paused for each work unit to wait for a play instruction.

For example, suppose that a trouble such as a jam occurs at the printing unit 149. To release the jam, works at plurality of regions are required. In this case, the moving image showing the required works is subdivided into a work for each position. On the other hand, there is a case where the user can recognize the work concept through one continuous display of the moving image. This is adequate for works responding to the status change of the device, such as toner bottle replacement work. In this case, it is not always necessary to subdivide the moving image. This is because even in a case where the toner replacement work is repeated several times, one display of the moving image is sufficient. In this case, it is sufficient to relate the work code of the moving image showing the toner bottle replacement work to the device. Note that, each work code is stored in relation with the installed position of the sensor groups 150 and 180.

As above, the guidance information is prepared in accordance with the type of trouble or state change of the device. Therefore, when these guidance information are played and displayed, different contents can be played and displayed dependent on the type of trouble or state change of the device.

In the present embodiment, two types of pattern of playing and displaying the moving image are stored. One is that, when moving image is played and displayed, the moving image is paused for each work unit to wait for a play instruction (a first moving image pattern). The other is that, when moving image is played and displayed, the moving image is continuously played (a second moving image pattern).

A SRAM (Static Random Access Memory) 205 is a volatile memory for temporarily storing image data including moving image and other data. An operation unit I/F 206 is the interface for transferring various information to and from the operation unit 170.

The various devices as mentioned above are interconnected via a system bus 207. An image bus I/F 208, which becomes an interface with an image bus 209, which will be described later, is also connected to the system bus 207.

A device I/F 210, a scanner image processing unit 211, a printing image processing unit 212, an image rotating unit 213, and an image compression unit 214 are connected to the image bus 209. The device I/F 210 is connected to the reader unit 139 and the printing unit 149 illustrated in FIG. 1 and transfers image data to and from these devices. At that time, the image data is converted to synchronous system or asynchronous system.

The scanner image processing unit 211 performs image processing to the image data in accordance with an instruction from the CPU 201. The image processing performed by the scanner image processing unit 211 includes noise elimination, movement, masking/trimming, magnification/reduction, and gradation conversion. The printing image processing unit 212 performs image processing to the image data. The image processing includes correction, resolution conversion and the like. The image rotating unit 213 performs image rotating processing to specified image data. The image compression unit 214 performs compression and expansion processing such as JPEG (Joint Photographic Experts Group) to multi-value image data. Also, compression and expansion processing such as JBIG (Joint Bi-level Image Experts Group), MMR (Modified Modified Read), MR (Modified Read), MH (Modified Huffman) and the like is performed to binary image data.

The operation of the devices as mentioned above or functional units connected to the image bus 209 are controlled by the CPU 201 which is connected through an image bus I/F 208.

The CPU 201 reads scanner image from the reader unit 139 connected via a reader unit interface 215. Then, the CPU outputs printer image to the printing unit 149 connected via a printing unit interface 216. The image data which is image-processed by the scanner image processing unit 211 is the scanner image. The image data which is image-processed by the printing image processing unit 212 is the image data which will be the printer image.

[Operation of Image Forming Apparatus (Work Support Method)]

Next, operation of the image forming apparatus 100 configured as above will be described. When there is a status change such as a state change of the device during an event which relates to an image formation, the image forming apparatus 100 according to the present embodiment realizes guidance function to guide work contents to be done by the user to respond to the state change. In addition, the image forming apparatus 100 according to the present embodiment has a guidance function to guide work contents to respond to a trouble. For example, when a trouble, such as a jam, which relates to the image formation occurs, the image forming apparatus guides the work contents to release the jam. Through the guidance functions, maintenance screen for supporting the release is displayed on an operation panel (display screen) of the operation unit by the control device 160. The guidance function is realized when the CPU 201 of the control device 160 executes control program stored in the ROM 203. Also, it is realized when the CPU 201 of the control device executes program for guidance held in the HDD 204.

<Toner Bottle Replacement Work>

First, description is made in a case where there occurred necessity of toner bottle replacement work as an example of work to be done by the user when there is a state change of the device.

FIG. 3A is an initial screen 301 of maintenance screen which is first displayed on the operation panel (display screen) of the operation unit 170 in a case where the state change of the toner bottle is detected. The continuously played moving image is displayed on the maintenance screen. In the moving image, work contents of the toner bottle replacement, from start to completion, is shown. A message indicating the work contents is displayed at a lower part of the moving image.

In the initial screen in FIG. 3A, when the moving image is touched while it is in a pause state, play and display of the moving image are started. Note that, an instruction button may separately be provided on the initial screen 301. The play and display of the moving image may be started through an operation of the instruction button. Also, the play and display of the moving image may be started through a specified key of keyboard. Following the play of the moving image in FIG. 3A for a predetermined time, play of moving image 302 in FIG. 3B is started. The moving image 302 shows a position of the toner bottle needed to be replaced. The moving image 302 also shows an operation to take out the toner bottle from the position.

Following the play of the moving image 302 in FIG. 3B, moving image 303 in FIG. 3C is played. The moving image 303 shows work contents indicating to replace with a new toner bottle. Following the play of the moving image 303 in FIG. 3C, moving image 304 in FIG. 3D is played. The moving image 304 shows work contents indicating how to remove a toner cap when the toner bottle is replaced with the new one. Following the play of the moving image 304 in FIG. 3D, moving image 305 in FIG. 3E is played. The moving image 305 shows how to insert the new toner bottle when the new toner bottle is attached to the image forming apparatus. Following the play of the moving image 305 in FIG. 3E, moving image 306 in FIG. 3F is played. The moving image 306 shows how to close a toner cover after the toner bottle is attached to the image forming apparatus. Following the play of the moving image 306 in FIG. 3F, moving image 307 in FIG. 3G is played. The moving image 307 shows how to close a front cover of the image forming apparatus main body after the new toner is attached to the image forming apparatus. Each moving image is displayed together with the message indicating the work contents.

<Jam Releasing Work>

Next, description is made with regard to a display example of maintenance screen, in a case where a jam occurs in the conveyance path of the printing unit 149, for performing guidance for work contents to release the jam. FIGS. 4A to 4H are schematic diagrams illustrating examples of screen transition of the maintenance screen displayed when the occurrence of the jam is detected.

FIG. 4A is an initial screen 401 displayed on the operation panel of the operation unit 170 when the occurrence of jam is detected. In FIG. 4A, the moving image in a pause state. When the maintenance screen is touched in this state, the play of the moving image is resumed. A main object in FIG. 4 is to explain how to play the moving image. Therefore, the detailed description with regard to a detailed configuration of inside of the image forming apparatus 100, including a paper delivery unit, a fixing unit, a duplexing unit and the like is omitted.

Following the play of the moving image in FIG. 4A, moving image in FIG. 4B is displayed in a pause state. When the user instructs to play the moving image, moving image of procedural operation is played, in which a way of drawing out the paper delivery unit to remove jammed paper is guided. Following the play of the moving image in FIG. 4B, moving image in FIG. 4C is displayed in a pause state. When the user instructs to play the moving image, moving image of procedural operation is played, in which a way of drawing out other paper delivery unit to remove jammed paper is guided. Following the play of the moving image in FIG. 4C, moving image in FIG. 4D is displayed in a pause state. When the user instructs to play the moving image, moving image of procedural operation is played, in which a way of drawing out an entrance unit of duplexing unit to remove jammed paper is guided. Following the play of the moving image in FIG. 4D, moving image in FIG. 4E is displayed in a pause state. When the user instructs to play the moving image, moving image of procedural operation is played, in which a way of drawing out the fixing unit to remove jammed paper is guided. Following the play of the moving image in FIG. 4E, moving image in FIG. 4F is displayed in a pause state. When the user instructs to play the moving image, moving image of procedural operation is played, in which a way of drawing out the duplexing unit to remove jammed paper is guided. Following the play of the moving image in FIG. 4F, moving image in FIG. 4G is displayed in a pause state. When the user instructs to play the moving image, moving image of procedural operation is played, in which a way of drawing out a registration unit to remove jammed paper is guided. Following the play of the moving image in FIG. 4G, a moving image in FIG. 4H is displayed.

<Display Control Procedure>

Next, with reference to FIG. 5A, an example of display control procedure performed by the control device 160 to realize the screen displays shown in FIGS. 3A to 3G and FIGS. 4A to 4H will be described.

Figure 5:
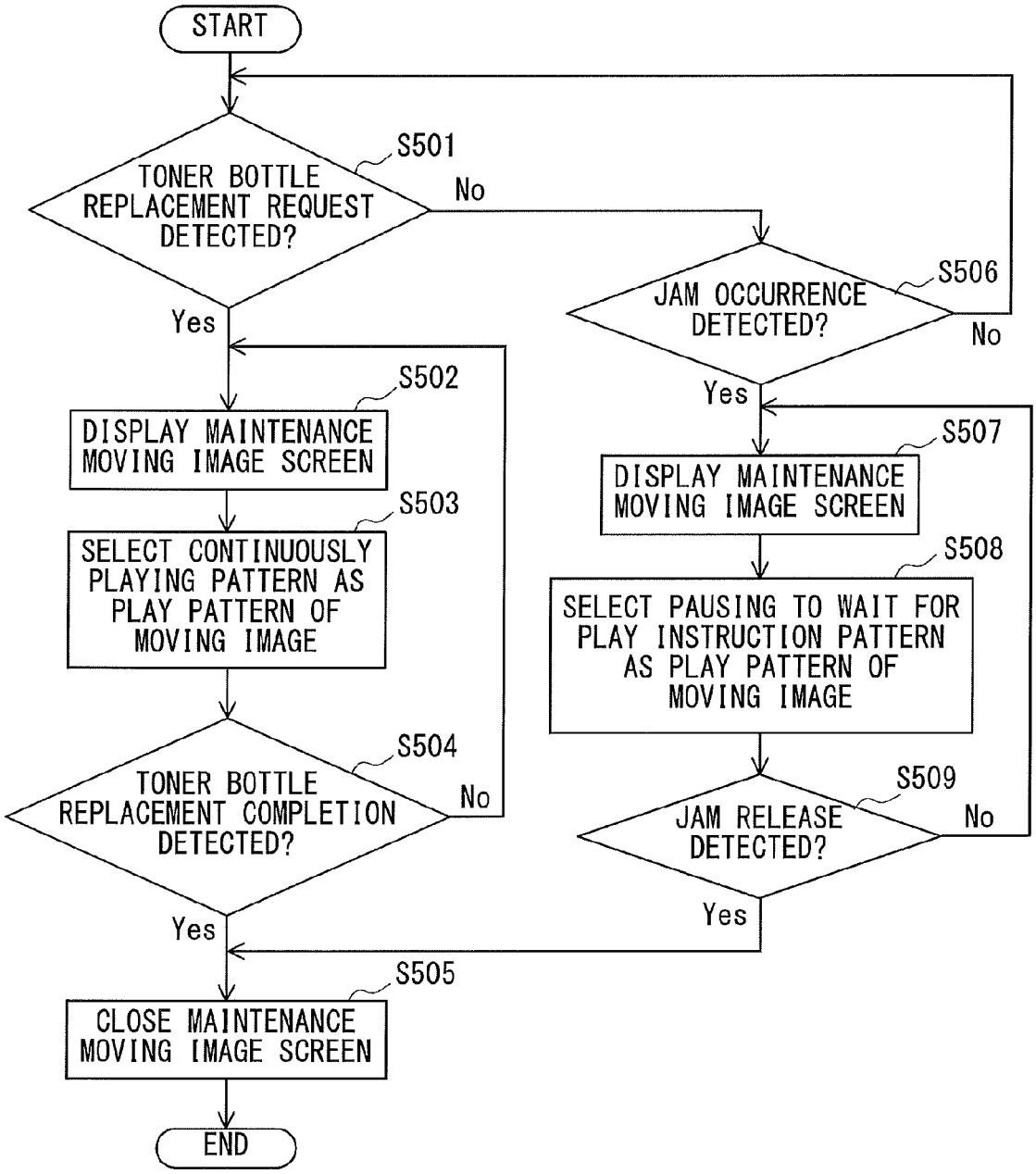
FIG. 5 is an explanatory diagram for explaining a display control procedure according to an embodiment.

When the control device 160 receives a request to execute copying, the display control shown in FIG. 5 is started. The request to execute copying is to print, by the printing unit 149, the image of the document by the reader unit 139. Alternatively, when the control device 160 receives a request to execute printing, the display control as shown in FIG. 5 is started. The request to execute printing is to print, by the printing unit 149, the image received from external information processing device.

The control device 160 determines whether or not a toner bottle replacement request is detected in the sensor group 150 of the printing unit 149 while the copying or the printing is executed (S501). If there is the toner bottle replacement request, the control device 160 displays the screen 301 for maintenance moving image as shown in FIG. 3A on the operation unit 170 (S501: Yes, S502). The screen for maintenance moving image will hereinafter be referred to as "maintenance moving image screen". Then, the control device 160 selects the second moving image pattern (in which the moving image is continuously played) as the moving image play pattern. Then, the moving images 302 to 307 as shown in FIGS. 3B to 3G are played (S503). Thereafter, it is determined whether or not there is a notification notifying a completion of toner bottle replacement (S504). This is determined based on whether or not the completion of toner bottle replacement is detected by the control device 160 in the sensor group 150 of the printing unit 149.

If the completion of toner bottle replacement is detected, the screen 305 of the maintenance screen displayed at S503 is closed (S504: Yes, S505). If the toner bottle replacement is not completed, the process returns to S502 (S504: No).

If the toner bottle replacement request is not detected at S501, the control device 160 determines whether or not occurrence of a jam is detected (S501: No, S506). If the occurrence of the jam is not detected, the process returns to S501 (S506: No).

If the occurrence of the jam is detected, similar to the operation at S502, the control device 160 displays the maintenance moving image screen (S506: Yes, S507). Then, the control device 160 selects the first moving image pattern (paused to wait for play instruction). Then, the moving images displayed on the maintenance moving image screen as shown in FIGS. 4A to 4H are played (S508).

Thereafter, the control device 160 determines whether or not the jam is released in the sensor group 150 of the printing unit 149 (S509). If it is determined that the jam is released, the maintenance screen is closed (S509: Yes, S505). If it is determined that the jam is not released, the process returns to S507 (S509: No).

Note that, while the moving image in FIGS. 3A to 3G is being played, the control device 160 can receive an instruction to cancel the play of the moving image. Also, instead of giving an instruction to play the moving image of the maintenance moving image screen in FIGS. 4A to 4H while the moving image is paused to wait for play instruction, the control device 160 can receive an instruction to cancel the play of the moving image. This allows cancelling the play of the moving image any time. Also, though not illustrated, while the moving image is paused to wait for play instruction, a "pattern switching" button may be operated. Through the operation, the play pattern may be switched to the first moving image pattern to the second moving image pattern, in which the moving images are continuously played. Therefore, the moving image which is first played in the first moving image pattern can thereafter be switched to be played in the second moving image pattern for the rest of the moving images.

<Display Screen Example>

Figure 6:
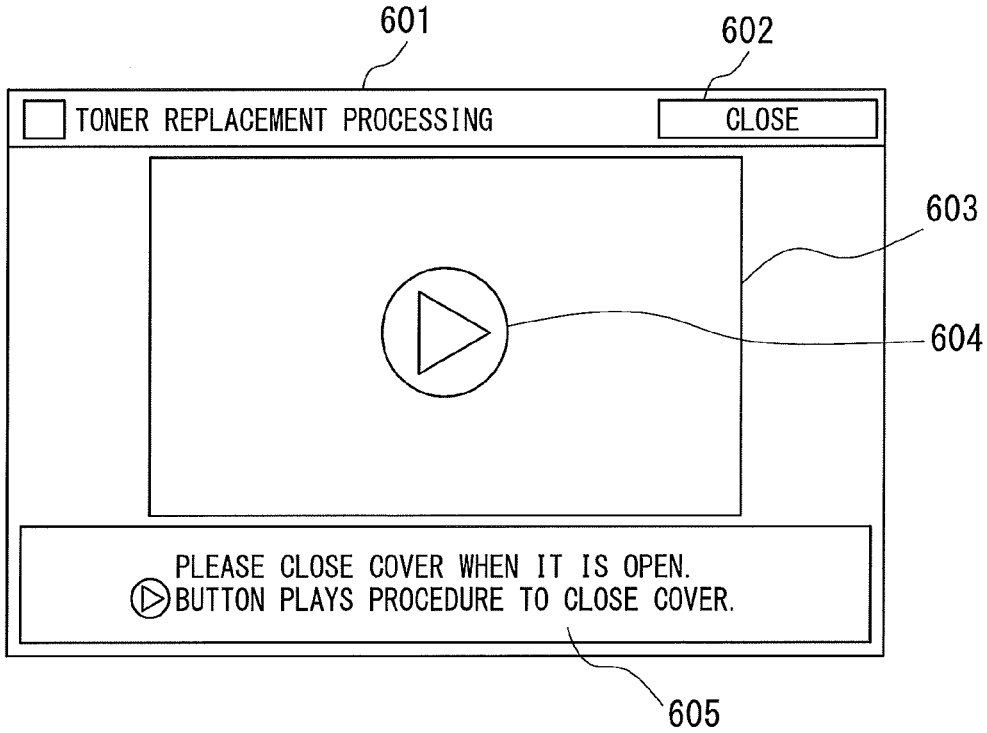
FIG. 6 is a schematic diagram illustrating a screen example displayed on the operation unit when the moving image is paused to wait for play instruction.

FIG. 6 is a diagram of an example of a maintenance moving image screen 601 displayed on a display panel (display screen) of the operation unit 170 at S502 and S507 of FIG. 5. A "close" button 602 is used to close the maintenance moving image screen. A play control 604 starts to display the moving image on a moving image display area 603, stops the moving image displayed on the moving image display area 603, or starts to play the moving image when the play control 604 is depressed while the moving image in a pause state. A message display area 605 displays a message, where supplemental information relating to the moving image displayed on the moving image display area 603 is displayed. Note that the "pattern switching" button may be provided on the maintenance moving image screen 601.

<Block Diagram of Software>

Figure 7:
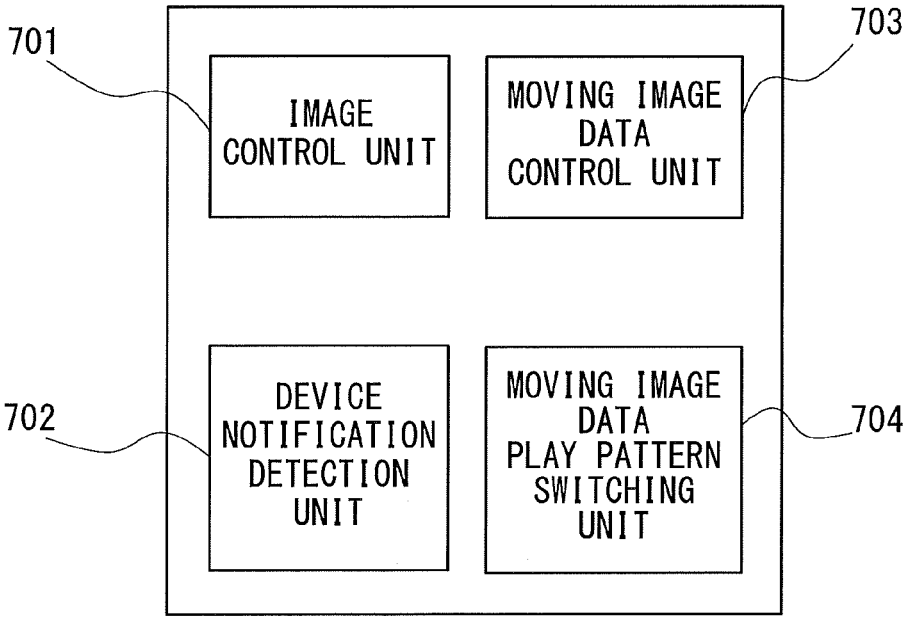
FIG. 7 is a block diagram illustrating a software configuration example of control device.

FIG. 7 is a block diagram illustrating a configuration example of software in the control device 160. The control device 160 operates as an image control unit 701, a device notification detection unit 702, a moving image data control unit 703, and a moving image data play pattern switching unit 704. By operating as these, the control device 160 realizes the guidance function as mentioned above.

Based on the guidance information stored in the HDD 204, the image control unit 701 performs processing to play and display the maintenance moving image screen as described with regard to S502 and S507 in FIG. 5. Based on the detection result obtained and appropriately input from the sensor groups 150 and 180, the device notification detection unit 702 performs processing as described above, which are, processing to detect the toner bottle replacement (S501), the completion of toner bottle replacement (S504), the occurrence of the jam (S506) and the release of the jam (S509). The moving image data control unit 703 generates the maintenance moving image screen based on the guidance information. Also, the moving image data control unit 703 relates message to each screen such that the related message is displayed on the screen. As described with regard to S503 and S508, the moving image data play pattern switching unit 704 performs processing to switch the play pattern of the moving image.

Note that, in the present embodiment, description has been made with regard to switching the play pattern of the moving image based on the type of works responding to the state change of the event including the state change of device. It is within the scope of the present embodiment to switch the play pattern of the moving image depending on the type of event or its configuration, for example, the type of device and its configuration. One example of the device is a main body of the image forming apparatus 100, and another example of the device is a finisher which is a post-processing apparatus after the image formation. In the latter case, for example, it can be set to resume play of the moving image without fail after a pause. The device may be configured by the image forming apparatus main body and the finisher. Also, the device may be configured by the image forming apparatus main body, an inserter, a folding machine, and an outer finisher may configure the device. In either configurations, the play pattern can be switched to either the first moving image pattern or the second moving image pattern. In this way, in a case where the play pattern of the moving image is switched depending on the type of device or its configuration, it is necessary to store the work contents of each device in the HDD 204 as maintenance information.

As mentioned above, in the present embodiment, for the toner bottle replacement work, the second moving image pattern, in which the moving images are continuously played, is selected. On the other hand, when the jam is detected and to cope with the situation, the first moving image pattern, in which the moving image is paused to wait for play instruction, is selected. This enables to perform work guidance to the user in an efficient manner.

Note that, even if the contents of the maintenance moving image are the same, just the play pattern may be switched to the second moving image pattern (in which the moving image is continuously played), or the first moving image pattern, in which the moving image is paused to wait for play instruction. As to the toner bottle replacement work, if one toner bottle is to be replaced, the second moving image pattern may be selected. If two toner bottles are to be replaced, the first moving image pattern may be selected.

Figure 8:
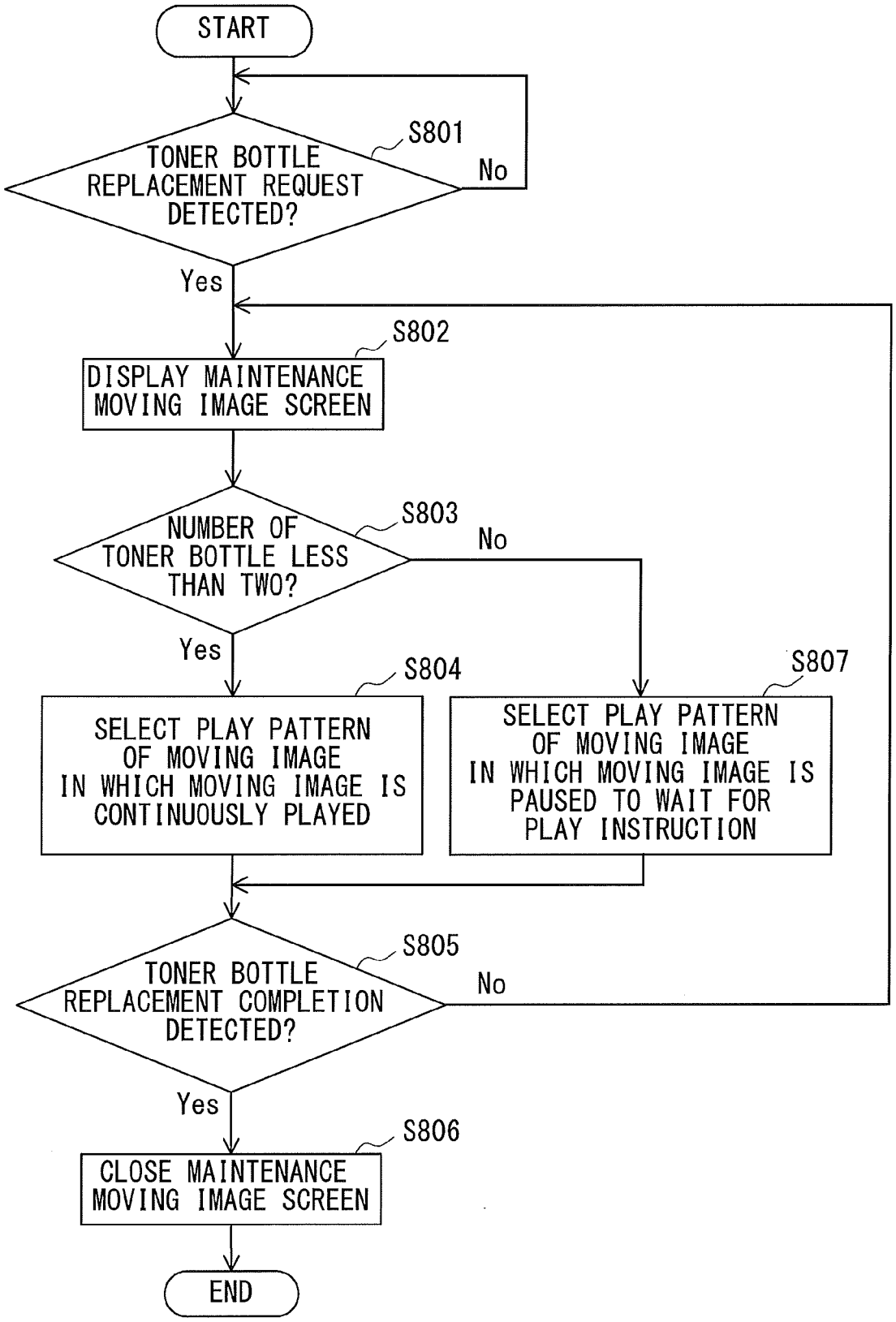
FIG. 8 is an explanatory diagram for explaining other display control procedure according to an embodiment.

An example of display control procedure performed by the control device 160 in such cases is described with reference to FIG. 8.

The control device 160 waits for a detection of a toner bottle replacement request (S801: No). If the toner bottle replacement request is detected (S801: Yes), the control device 160 displays the initial screen 301 as shown in FIG. 3 on the operation unit 170 (S802).

Thereafter, the control device 160 determines whether the number of the toner bottles to be replaced is less than 2 (S803). If the number of the toner bottles to be replaced is less than 2, that is, the number of the toner bottles to be replaced is one, the control device 160 selects the second moving image pattern (S803: Yes, S804). If the number of the toner bottle to be replaced is not less than 2 (S803: No), the control device 160 selects the first moving image pattern. Then, when the play of the maintenance moving image screen in FIG. 3F is finished, that is, when the play of the moving image for closing the toner cover is finished, the play of the moving image is paused before playing the moving image for the second bottle replacement. Thereafter, when the user instructs to play the moving image, play of the moving image showing the second bottle replacement work is started. Note that the maintenance moving image screen showing the contents of the second bottle replacement work is just as shown in FIGS. 3A to 3F, therefore, the description is omitted. Also, the processing of S805 is the same as the processing of S505. The processing of S806 is the same as the processing of S505. Therefore, the description thereof is omitted.

Note that as to the second and following toner bottle replacement works, in a case where the work contents are understandable by viewing the work contents for the first toner bottle replacement, the second play of the moving image may be cancelled. For example, by receiving the operation of the "close" button displayed at any time on the maintenance moving image screen as shown in FIGS. 3A to 3F, the control device 160 can cancel the play of the moving image at any time and close the maintenance moving image screen. Due to this, the users are not forced to view the second moving image, which enables to perform guidance without giving any stress to the user.

As mentioned above, according to the image forming apparatus 100 of the present embodiment, when moving image is played in the first moving image pattern, the moving image is paused for each work unit in accordance with the work contents to be done by the user. Also, then the moving image is played in other pattern, the moving image is continuously displayed. In this way, play pattern of the moving image can be selected in accordance with the work contents. This enables to improve the usability when performing guidance for work procedure. For example, when less time-consuming work is performed, by continuously playing the moving image, usability in viewing the guidance can be improved. On the other hand, in a case where such work as drawing out a door of the image forming apparatus 100 or drawing out the device positioned inside is needed, by pausing the moving image to wait for play instruction, taking into account of user's burden, improved usability is achieved.

Note that, in the present embodiment, description has been made with regard to a case where the jam occurs in the conveyance path as an example of trouble. The trouble, however, is not limited to the jam as long as it is related to the image formation.

Also, in the present embodiment, toner bottle or its mounting interface has been given as the example of the device. The device, however, may be that which relates to replacement of consumables such as printing recording sheet or toner.

Also, in the present embodiment, description has been made with regard to the example in which storage medium is held in the control device 160 (ROM 203, HDD 204), the storage medium for storing computer program performed by the CPU 201 for realizing the guidance function, it is not limited to the example. For example, the computer program may be read from DVD (Digital Versatile Disk), USB (Universal Serial Bus) memory or other computer readable compact disc by the CPU 201.

Also, the computer program may appropriately be downloadable by the image forming apparatus 100 from any accessible server. Further, not limited to the case where the CPU 201 executes all processing, by accessing the server as mentioned above, CPU of the server may execute part of or all the processing performed by the CPU 201.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-213618, filed Oct. 11, 2013, which is hereby incorporated by reference herein in its entirety.

What is claimed is:

1. An image forming apparatus comprising:

a detector configured to detect an event which relates to an image formation;

a memory configured to store a plurality of moving images which are prepared for respective work units;

a display device configured to play a moving image; and a controller configured to control to selectively switch a playing pattern between a first playing pattern and a second playing pattern based on content of the event detected by the detector, wherein, in the first playing pattern, after playing of the moving image of the plurality of moving images corresponding to the detected event is completed, the moving image is paused, and playing of a next moving image is started upon receiving a play instruction from a user, and in the second playing pattern, after playing of the moving image of the plurality of moving images corresponding to the detected event is completed, the moving image is not paused, and the next moving image is continuously played.

2. The image forming apparatus according to claim 1, wherein the event is an occurrence of trouble, the detector detects the occurrence of trouble and a type of trouble, and the controller controls to selectively switch between the first playing pattern for playing the moving image and the second playing pattern for playing the moving image based on the type of trouble detected by the detector.

3. The image forming apparatus according to claim 1, wherein the controller is further configured to control, when an instruction to cancel play of the moving image is received while the moving image is being played in the first playing pattern, or when an instruction to cancel play of the moving image is received instead of a play instruction to play the moving image in the second playing pattern, to cancel the play for the rest of the moving image.

4. The image forming apparatus according to claim 1, wherein the controller is further configured to control, when an instruction to switch to play the moving image in the second playing pattern is received after starting to play the moving image in the first playing pattern, to switch the moving image which is not yet played in the first playing pattern to be continuously played in the second playing pattern.

5. The image forming apparatus according to claim 1, wherein the controller is further configured to control to play the moving image in the first playing pattern in a case where the event detected by the detector is an occurrence of a jam, and to play the moving image in the second playing pattern in a case where the event detected by the detector is a toner bottle replacement.

6. The image forming apparatus according to claim 1, further comprising a reader configured to read an image on a document to form image data.

7. The image forming apparatus according to claim 1, further comprising a printer configured to print an image on a sheet based on the image data.

8. The image forming apparatus according to claim 1, wherein the controller is further configured to play the moving image in the first playing pattern, when playing a plurality of moving images which show replacement procedures for a first toner bottle, and when playing a plurality of moving images which show replacement procedures for a second or following toner bottle, in a case where the event detected by the detector is a replacement of two or more toner bottles.

9. A work support method of an image forming apparatus which includes a detector configured to detect an event which relates to an image formation and a memory configured to store a plurality of moving images which are prepared for respective work units, and a display device configured to play the moving image, the method comprising a step of:

selectively switching, based on content of the event detected by the detector, a playing pattern between a first playing pattern and a second playing pattern, wherein, in the first playing pattern, after playing of the moving image of the plurality of moving images corresponding to the detected event is completed, the moving image is paused and playing of a next moving image is started upon receiving a play instruction from a user, and in the second playing pattern, after playing of the moving image of the plurality of moving images corresponding to the detected event is completed, the moving image is not, and the next moving image is continuously played.

10. The work support method of an image forming apparatus according to claim 9, wherein the event is an occurrence of trouble, and further comprising steps of:

detecting the occurrence of trouble and a type of trouble; and selectively switching between the first playing pattern for playing the moving image and the second playing pattern for playing the moving image based on the type of trouble detected in the detecting step.

11. A non-transitory computer-readable storage medium storing a program that when executed causes a computer, which is adapted to connect to a detector configured to detect an event which relates to an image formation, memory configured to store a plurality of moving images which are prepared for respective work units, and a display device configured to play the moving image, to perform a step of:

selectively switching a playing pattern between a first playing pattern and a second playing pattern based on content of the event detected by the detector, wherein, in the first playing pattern, after playing of the moving image o of the plurality of moving images corresponding to the detected event is completed, the moving image is paused, and playing of a next moving image is started upon receiving a play instruction from a user, and in the second playing pattern, after playing of the moving image of the plurality of moving images corresponding to the detected event is completed, the moving image is not paused, and the next moving image is continuously played.

12. The non-transitory computer-readable storage medium according to claim 11, wherein the event is an occurrence of trouble, and further causing the computer to perform steps of detecting the occurrence of trouble and a type of trouble; and selectively switching between the first playing pattern for playing the moving image and the second playing pattern for playing the moving image based on the type of trouble detected in the detecting step.

* * * * *